United States Patent [19]

Anderson et al.

[11] 4,305,256

[45] Dec. 15, 1981

[54] CRYOGENIC GEL HAVING A METHANE COMPONENT AND PROCESS FOR MAKING SAME

[75] Inventors: Roger E. Anderson, Rancho Cordova; Eugene M. Vanderwall, Citrus Heights, both of Calif.

[73] Assignee: Aerojet Liquid Rocket Co., Sacramento, Calif.

[21] Appl. No.: 120,205

[22] Filed: Feb. 11, 1980

[51] Int. Cl.[3] ..... F25C 3/00

[52] U.S. Cl. ..... 62/48; 23/295 G; 44/7 D; 44/52; 48/196 FM; 206/568; 252/70

[58] Field of Search ..... 62/48, 1; 23/295 G; 44/7 D, 52; 48/196 FM; 206/568; 252/67, 70, 316

[56] References Cited

U.S. PATENT DOCUMENTS 4,011,730 5/1977 Rosenberg et al. ..... 62/48

*Primary Examiner*—Ronald C. Capossela

*Attorney, Agent, or Firm*—Townsend and Townsend

[57] ABSTRACT

Disclosed is a cryogenic gel, and a process for making such a gel from a liquid cryogen having at least a methane component, which normally comprises a majority of the cryogenic liquid, by flash vaporizing the cryogen so that a relatively small portion of the weight of the cryogen becomes vaporized while a remainder forms a mist of small cryogen droplets suspended in the vapor. After flash vaporization, a gelling agent is injected into the cryogen vapor-mist mixture. The gelling agent is present so that it forms between about 0.1% to about 25% (by weight) of the resulting gel and is selected so that it is a solid at the temperature of the liquid cryogen and a liquid or a gas at ambient temperature. Water and methyl alcohol are preferred gelling agents. After the injection of the gelling agent the mixture is segregated into a gaseous phase and a condensed phase or gel comprising the liquid cryogen droplets and the injected gelling agent.

37 Claims, 3 Drawing Figures

CRYOGENIC GEL HAVING A METHANE COMPONENT AND PROCESS FOR MAKING SAME

BACKGROUND OF THE INVENTION

Gaseous fuels are frequently liquefied to reduce the volume they occupy during transport and storage. Typically, the gas is liquefied at or in the vicinity of its production site, it is then stored and/or shipped in containers to its point of use, and there it is gasified again before it is distributed to users. There are a variety of such gases, however, by far the most common gas is natural gas which includes methane as its major component. Although the present invention is applicable to a number of gases, as is further discussed below, all such gases will hereinafter be sometimes collectively referred to as "natural gas," a definition intended to include all gases which have at least a methane component.

As the use of liquefied fuels continues to grow, its potential hazards to humans and property are immense because of the very large energy that is concentrated in such liquefied gases. The greatest danger in connection with the storage, handling and shipment of liquefied natural gas is posed by potential spills due to collisions, rupture of containers or similar accidents. In such instances the liquid natural gas (LNG) escapes onto the ground or the water surface where it rapidly evaporates into gas clouds which can cover very large surface areas and which can move over relatively large distances before they are sufficiently diluted so as to preclude their explosion. Before such dilution even a minor spark or flame can set off an explosion which can release energy equivalent to up to thousands of tons of TNT.

This danger posed by LNG has of course been recognized for some time. To alleviate the rapid outflow of LNG if its container should be ruptured, it has previously been proposed to gel the LNG. U.S. Pat. No. 4,011,730 discloses and claims a method by which LNG is gelled through mixing relatively small amounts of finely divided solid particles of water or methyl alcohol with the LNG. In accordance with the method disclosed in that patent the gelling agent, say steam, is injected into the LNG via a tube submerged in the LNG. Steam may be directly injected or it may first be entrained in a carrier gas such as helium or methane.

To effectively gel the LNG the steam and the resulting solid particles must be relatively uniformly dispersed throughout the LNG pool. Because of the extremely low temperatures of LNG this is not always an easy task since the solid particles tend to agglomerate around the tube and can also cause it to become plugged.

SUMMARY OF THE INVENTION

In contrast to the LNG gelation process described in the above-referenced U.S. Patent, the present invention transforms a liquid cryogen including at least a methane component e.g. LNG, into a cryogen gel by converting the liquid cryogen into a body of cryogen comprising by weight a minority of cryogen vapor and a majority of cryogen mist, i.e. cryogen droplets suspended in the vapor. A vaporized gelling agent is added to this body of cryogen. The selected gelling agent must be a solid at the temperature of the cryogen and either a gas or a liquid at ambient temperature so as to facilitate its subsequent separation from the cryogen. Further, the gelling agent should be one which forms weak addition or coordination compounds with the methane, or clathrates.

Although applicants do not presently fully understand the mechanism by which gelling agents gel a cryogenic liquid, that is give a liquid yield strength and thereby impart to the liquid some characteristics of a solid or semi-solid material, it is believed that the gelling agent forms a chemical complex with the cryogenic liquid such as that of weak addition compounds, coordination compounds and/or clathrates, and that the formation of such a chemical complex is most effective is not necessary to achieve a gelling of the cryogen liquid. Further, applicants acknowledge the possibility that liquids can be gelled with gelling agents which do not become liquid or gaseous at ambient temperature, such as silica. However, for most if not all applications the separation of such (solid) gelling agents from the cryogen upon the gasification of the latter would be most difficult and impractical. Therefore, at the present applicants believe that the use of such gelling agents is not practical as far as the present invention is concerned.

Although the present invention can be advantageously employed for the gelling of liquid cryogens having a methane component in which the proportion of methane can vary over a wide range, it is presently believed that the greatest benefits are obtained when gelling liquid cryogens which have a relatively large methane component, e.g. LNG. For the gelation of LNG, applicants presently contemplate that the gelling agent will be selected from the class consisting of water and methyl alcohol because both exhibit the above enumerated required characteristics for the gelling agent. Further, when water is used as the gelling agent, it is readily and relatively inexpensively available; it results in a strong gel even at relatively low concentrations; and it can be segregated from the gelled LNG when the latter is gasified without difficulties, environmental problems or adverse affects on the resulting gas. Methyl alcohol, on the other hand, is a viable gelling agent for LNG because it exhibits the desired characteristics and, upon the gasification of the LNG it becomes part of the resulting gas, can be combusted with it and thereby adds to the energy content of the gas. Because methyl alcohol does not adversely affect the energy balance of the gelling process to as large an extent as does water, it can be present in the gelled LNG in substantially greater proportion than water without detracting from the efficiency of the process.

Applicants have determined that the effectiveness of water as a gelling agent is about double that of methyl alcohol, that is for a given gel strength (as further defined below) it is necessary to add approximately twice as much methyl alcohol as water to the LNG. The concentration ranges discussed below take this characteristic into account and whenever a given concentration range is stated for either water or methyl alcohol, the concentration for the other should be approximately doubled or halved, respectively.

Further, it is, of course, possible to use as a gelling agent a mixture of water and methyl alcohol. In such a case, the proportion of the mixture for a given gel strength is to be adjusted as compared to the proportion of water or methyl alcohol alone in the gelled LNG in accordance with the relative proportions of water and methyl alcohol in the mixture.

The exact proportion of gelling agents added to the liquid cryogen, say LNG depends both on the gelling agent that is employed and on the desired characteristics of the gel. The liquid cryogen begins to gel, that is exhibits some yield strength at very low concentration levels. Although such low gel strength levels might not be desirable for many applications, such as for storing or shipping LNG, low strength gels have certain other characteristics which can make them desirable. For example, when water is the gelling agent for LNG and is present at about 0.1% (by weight) of the resulting cryogen gel, the latter exhibits excellent and highly desirable heat transfer characteristics which can be advantageous for certain applications as, for example, in the field of rocketry.

At gelling agent concentration levels below about 0.1%, for either water or methyl alcohol, the gelling effect of the agent becomes so small as to be practically nonexistent. Accordingly, applicants consider a gelling agent concentration in the cryogen gel of about 0.1%, for either water or methyl alcohol and, by deduction, for any other gelling agent, to be the minimum effective concentration.

Returning now to the process of the present invention, sufficient gelling agent is, therefore, added to the liquid cryogen so that it comprises at least about 0.1% by weight of the cryogen gel. After the addition of the gelling agent the cryogen body is separated into a condensed phase comprising a liquid cryogen and gelling agent and a gaseous phase comprising primarily cryogen vapor, and the condensed phase is collected in a container.

The present invention contemplates to accomplish the gelation on a continuous basis. Thus, a stream of cryogenic liquid which includes methane, e.g. LNG, is pumped or pressurized to a predetermined pressure and its temperature is brought to the vicinity of the boiling point for the liquid at that pressure. The liquid is flowed to an expansion or throttling station where the pressure of the flowing liquid is reduced so that a portion, typically a minor portion of the liquid cryogen becomes vaporized while the remainder of the liquid becomes atomized. This transforms the liquid cryogen stream into a flow of cryogen vapor and liquid cryogen droplets, that is, a mist.

Next, the vaporized gelling agent, e.g. steam or methyl alcohol vapor, is injected into the cryogen flow at a rate which is selected so that the weight of the gelling agent vapor equals about 0.1 to about 25% the weight of the cryogen liquid in the flow; the upper limit being for methyl alcohol as a gelling agent and the cryogen being a liquid wherein the methane comprises a majority of the liquid. If water is used as the gelling agent and if the gel is to have about the same strength, its relative concentration in the cryogen is approximately half, e.g. the upper limit is in the vicinity of about 12% by weight. Although the stated gelling agent concentrations are appropriate ranges for cryogen liquids having methane as a majority component, such as LNG, they are not absolute ranges in a technical sense of the word. Greater concentrations can be employed in cryogen liquids having methane as a majority component and might sometimes be necessary in instances in which the methane component is only a minority of the cryogen liquid. However, such extended ranges will usually be economically unfeasible for reasons further discussed below.

The injection of the gelling agent vapor causes its solidification into crystals or particles to form "gelling particles." As mentioned earlier, applicants believe (but are not certain) that the gelling particles actually are a combination of the gelling agent and methane into a chemical complex such as clathrates, that is, methane-gelling agent particles.

The combined flow of cryogen droplets, cryogen vapor and gelling particles is now segregated, typically in a cyclone separator, into a condensed phase comprising liquid cryogen and the gelling particles and a gaseous phase comprising primarily cryogen vapor. The condensed phase is collected in a suitable container and upon coming to rest is readily stored and/or transported.

The condensed phase, of course, now is a gel. In other words, the cryogen liquid has been transformed into a gel substance which exhibits yield strength and thus resists flow to a greater or lesser extent depending on the type and amount of gelling agent and other factors. When the gel is in a container, either a stationary storage container or a movable shipping container, the rupture of the container will result in a reduced gel outflow rate. Similarly, the yield strength of the gel will reduce its propensity to flow and spread on the ground or a water surface which is of particular significance in regard to LNG which exhibits an extremely low viscosity in its liquid state and thus has a propensity to rapidly spread and flow. The reduced flow rate of gelled LNG from a container and the reduction in the speed with which it spreads, therefore, greatly reduces the dangers presented by an LNG spill. Further, the gelled LNG has a substantially reduced evaporation rate as compared to LNG which reduces the size of the ensuing and potentially explosive gas cloud and thereby also facilitates its dilution with atomospheric air so that the explosiveness of the gas cloud is diminished both in terms of its size and time duration.

The gaseous phase is preferably recirculated by first reliquefying it and then combining the reliquefied phase with incoming liquid cryogen at a point upstream of the expansion station. Alternatively, the gaseous phase can be used directly elsewhere or it can even be discharged into the atmosphere although the latter alternative will not usually be desirable.

As mentioned earlier, at the expansion or throttling station a portion of the cryogen liquid is vaporized while the remainder is atomized and the resulting droplets are entrained in the cryogen vapor. Since the proportion of vaporized liquid cannot be recaptured as cryogen gel without reliquefaction of the vapor, which requires energy and costly apparatus, and since it is desired to maximize the amount of cryogen gel ultimately recovered from the process of the present invention, the amount of cryogen liquid that is evaporated should be minimized. On the other hand, applicants have determined that by increasing the relative proportion of cryogen vapor (downstream of the expansion station) to injected gelling agent, the ultimate gel strength can be increased. From a technical point of view, a minimum cryogen vapor to gelling agent vapor ratio (by volume) of about 1:1 is desirable to assure a good dispersion of the gelling agent in the cryogen. The upper limit is dictated primarily by economic considerations. From a technical point of view, the cryogen vapor to gelling agent vapor ratio (by volume) may be as high as 20:1 or more. Economic considerations, however, will normally limit that upper ratio to about 10:1 with a presently preferred range being 2:1 to about 4:1 by volume.

It is apparent that increased gel strength can be obtained by correspondingly increasing the proportion of gelling agent that is added to the cryogen. However, in view of the relatively high temperature of the injected gelling agent, e.g. steam, each weight percent of water as the gelling agent added to the cryogen causes a significant additional vaporization of the cryogen. Since vaporized cryogen cannot be gelled without recycling and reliquefying it as is outlined above, economical considerations in combination with desired gel yield strengths will normally limit the amount of injected gelling agent to no more than about 10% by weight of the cryogen gel for water, a preferred range for the gelling agent (water) concentration being between about 1.5% by weight and about 5% by weight of the cryogen gel.

From the foregoing it will be apparent that there is a wide latitude in the selection of process parameters. Specific values will normally be chosen based on (a) the desired gel yield strength and (b) the most economic manner in which that yield strength can be obtained by appropriately varying the cryogen vapor to gelling agent ratio and the concentration of the gelling agent in the cryogen gel. Once these parameters have been selected, the actual gelation of the liquid cryogen can be readily performed.

In most instances, the cryogen gels will be stored at atmospheric pressure so that the incoming liquid cryogen stream is pressurized slightly above atmospheric pressure, typically in the range of between about 5 to 25 psi above atmospheric pressure. At 10 psi excess pressure approximately 4.5 weight percent of the liquid cryogen is vaporized. This cryogen vapor occupies approximately 92% of the combined cryogen vapor-cryogen droplet volume. At a dilution ratio of cryogen vapor to gelling agent of around 3:1 (by volume) this yields a gelling agent concentration in the cryogenic gel of roughly 2.0 weight percent, a value which results in a gel having a relatively low strength.

At 20 psi excess pressure approximately 8 weight percent of the liquid cryogen is vaporized and this cryogen vapor occupies approximately 94% of the combined vapor and droplet volume. At a similar 3:1 (by volume) cryogen vapor to gelling agent (water) dilution ratio, a gel containing approximately 3.5% water as the gelling agent results. Such a gel has a relatively high strength.

In practice the liquid cryogen stream is flowed through a suitable pressure reducing device such as an expansion nozzle, a cavitating venturi, a throttling valve, or the like, and the desired amount of gelling agent is injected immediately downstream of the device. The resulting mixture, comprising liquid cryogen droplets, gelling particles (clathrates) and cryogen vapor is then introduced into a suitable separator such as a cyclone separator where the vapor is withdrawn as a gaseous phase for recirculation. The droplets and gelling particles comprising the gel are collected in a suitable container. The gel of the present invention is characterized by a highly uniform dispersion and, therefore, has a correspondingly uniform and homogeneous strength.

The process of the present invention for gelling liquid cryogens which include methane, and typically for gelling LNG, is continuous and, therefore, can form an integral part of an LNG liquefaction plant. It can also be added to existing liquefaction plants by taking the LNG output and appropriately pressurizing and/or heating the LNG so as to obtain the desired cryogen flash vaporization condition. An existing LNG liquefaction plant can thus be converted without major expenditure into an LNG gel plant. The gel, which flows when stressed and can be readily pumped but which exhibits significant strength (when stationary in its storage and/or shipping container) now poses a much lesser danger should the container rupture or should an LNG gel leak occur otherwise, since the gel flows only slowly, if at all, through leaks, ruptured walls and the like. More importantly, the gel has a much lesser propensity to spread, thereby significantly reducing the boiloff and the ensuing LNG cloud which can otherwise pose such grave danger to the areas surrounding the spill.

DESCRIPTION OF THE PREFERRED EMBODIMENT

Figure 1:
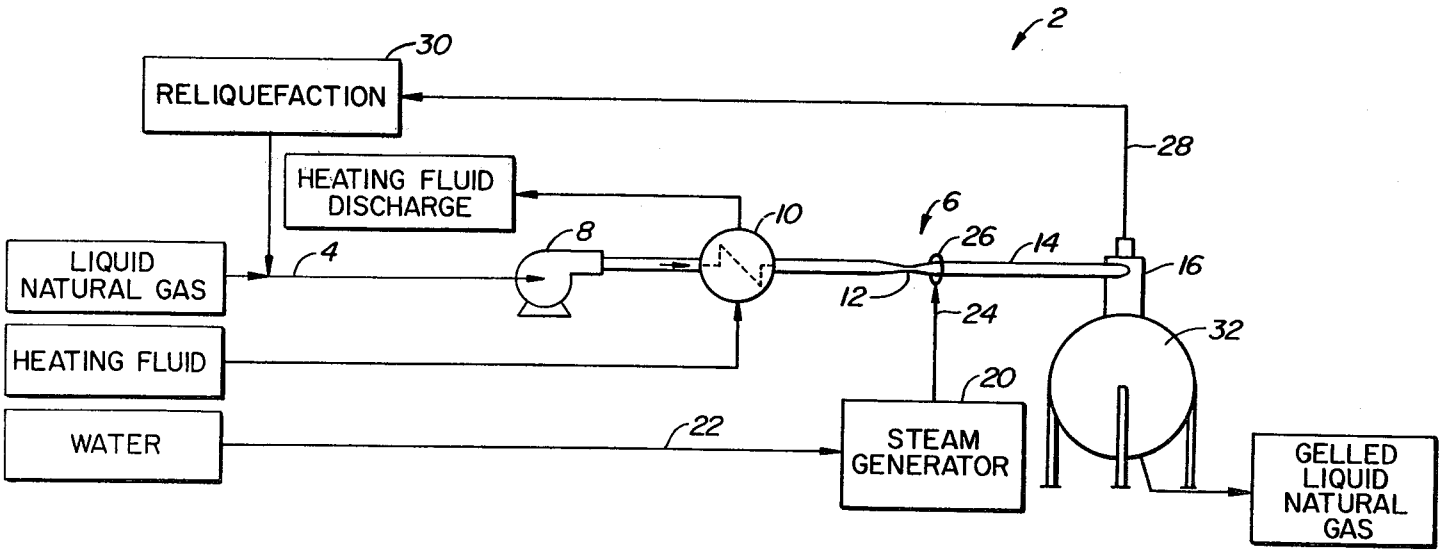
FIG. 1 schematically illustrates an LNG gellation plant constructed and operated in accordance with the present invention.

Referring to the drawings, a system 2 for gelling a liquid cryogen (hereinafter usually referred to as "LNG") comprises an LNG inflow pipe 4 which transports LNG from a liquefaction plant (not separately shown in the drawings) to a gelling or expansion station 6. For instances in which the gellation system constitutes an integral part of the liquefaction plant, inflow pipe 4 normally leads directly to the gelator. If, however, the gellation plant is an addition to an existing liquefaction plant it will frequently be necessary, for reasons further discussed below, to provide a booster pump 8 and an LNG conditioner, e.g. heater 10, upstream of the gelator.

Figure 2:
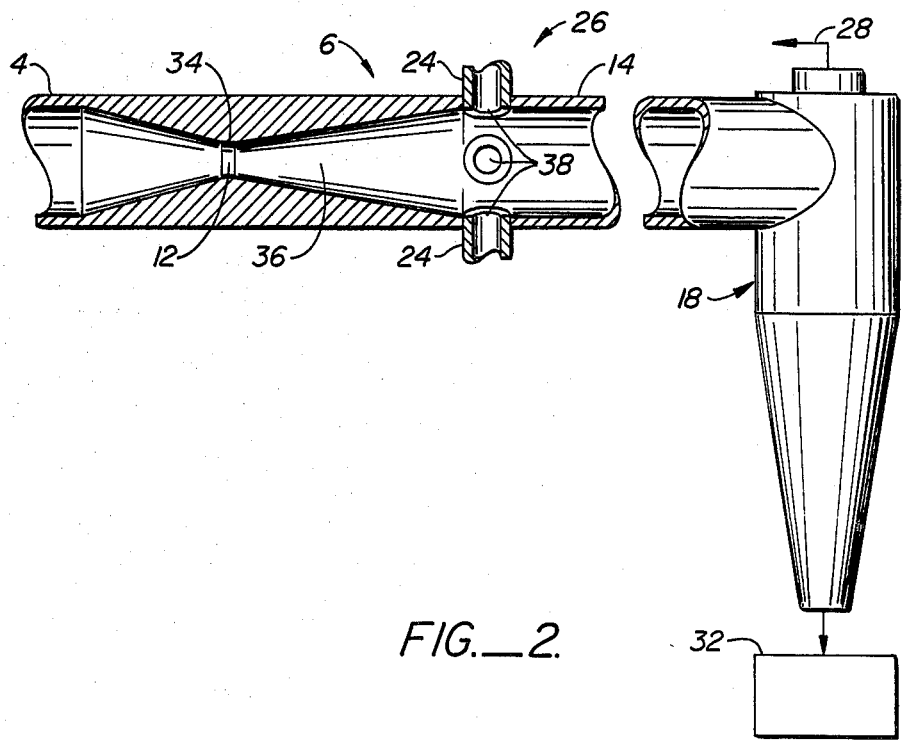
FIG. 2 is a detailed view of a portion of the apparatus employed by the present invention.

In the gelator, which may comprise a venturi expander 12 as is illustrated in FIG. 2 but which alternatively may be a throttling valve, an expansion valve or the like, the LNG is transformed into a flow of natural gas (hereinafter frequently referred to as "NG" to "vapor") and mist of atomized LNG droplets suspended in the vapor which flows via a flow pipe 14 to a separator 16 such as the cyclone separator 18 illustrated in FIG. 2.

A conventional steam generator 20 such as a boiler receives water via an intake line 22 and flows steam via a steamline 24 to a steam injector 26 positioned so that the steam is injected into the vapor-droplet flow in flowpipe 14.

The gas-liquid separator 16 segregates the vapor-droplet flow into a gaseous phase which is returned to the LNG inflow pipe 4 via a vapor pipe 28 and a reliquefaction station 30 (which may be the primary liquefaction plant or a separate liquefier) so that vapor separated from the flow is returned to the LNG flow for recirculation through the gelator. A condensed phase (gel) formed in the separator is preferably gravitationally discharged into a storage vessel or container 32 where it comes to rest. Once the gel is at rest it exhibits a yield strength and thereby forms the end product of the present invention, namely a cryogen gel, e.g. an LNG gel.

The LNG gel can be withdrawn from the storage vessel by flowing or pumping it out of the vessel since the gel, when set in motion, is readily flowable; that is the gel will flow when a stress applied to it exceeds its yield strength.

Figure 3:
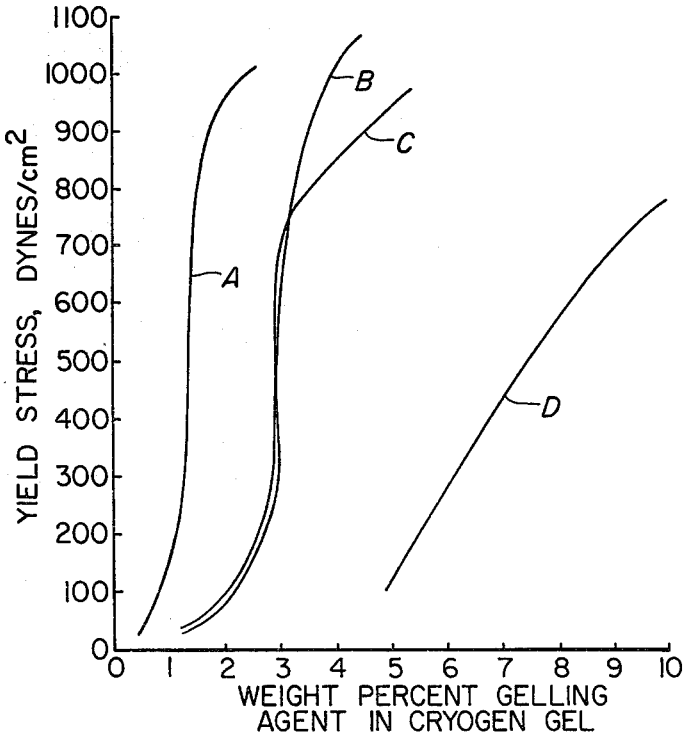
FIG. 3 graphically illustrates the relationship between LNG gel yield strength and the concentration of gelling agent in the gel.

Referring briefly to FIG. 3, the relationship between gel strength (in dynes/cm$^2$) and gelling agent concentration (by weight) in the gel and the influence thereon of the cryogen vapor to gelling agent ratio (by volume), hereafter sometimes "dilution ratio", are graphically illustrated. When the gelling agent is introduced into the liquid cryogen in accordance with the present invention, i.e. by injecting the gelling agent into a cryogen vapor-cryogen droplet mixture, the gel strength rises as a fucntion of the gelling agent concentration therein. Applicants believe but they have not actually determined that the gel strength approaches zero at very low gelling agent concentrations, e.g. at concentrations of less than 0.1%. The exact point at which the gel strength reaches zero is presently not known to applicants. At gelling agent concentrations in the gel (whether it is an LNG gel or pure methane gel) of less than about 1% by weight, the yield strength of the gel is generally less than 200 dynes/cm$^2$.

Although an increase in the gelling agent concentration results in corresponding increases in the gel strength, a practical limit is set by economic considerations. The more gelling agent, e.g. the more steam, is injected into the cryogen (e.g. LNG) vapor-droplet flow at the expansion station 26 the more LNG is vaporized. Consequently, the yield of gel per pass is correspondingly reduced and the amount of NG vapor that must be recycled and reliquefied is correspondingly increased. Since the recirculation and in particular the reliquefaction of the vapor requires relatively costly energy it is desired, from an economical point of view, to minimize the amount of vapor that needs to be recirculated. For practical considerations, therefore, applicants consider a gelling agent concentration in the gel of about 10% (by weight) for water and of about 20–25% by weight for methyl alcohol to be an upper limit under prevailing operating conditions, particularly under prevailing energy costs.

FIG. 3 also illustrates the effect of varying the dilution ratio between the (NG) vapor and steam. Curve A illustrates the relationship between gel strength (pure methane gel) and gelling agent steam concentration in the gel when the ratio of methane vapor to injected steam is 40:1 (by volume). If the methane vapor to steam ratio is reduced to 2:1 the yield strength of the gel drops somewhat in comparison to the 40:1 ratio as is illustrated by Curve B.

Curve C was developed by initially preparing a relatively weak LNG gel from a simulated NG (85% methane, 10% ethane, and 5% propane, by volume) using a 2:1 methane vapor to steam dilution ratio. The gel was then gradually evaporated (by sparging with helium) and methane was preferentially boiled off, resulting in an increase in the gelling agent concentrations and a decrease in the concentration of methane in the gel. When the gelling agent concentration increased to about 3% (by weight) and the methane concentration in the gel dropped to about 70 mole percent the gel strength began to rise perceptively slower even though the relative gelling agent concentration in the gel continued to increase as is apparent from the reduction in the slope of Curve C. This demonstrates two points.

First, at relatively high methane concentrations in the gel, that is at methane concentrations of 70 mole percent or more the gel behaves substantially identical to a pure methane gel. Since LNG typically has a methane component in excess of 70 mole percent, Curve C illustrates that LNG gel has strength characteristics which are about equal to those of methane gel if the gelling agent concentration and the cryogen vapor to gelling agent dilution ratio are the same.

Secondly, Curve C illustrates that gelling of a cryogen liquid having a methane component takes place even at lower concentrations of methane in the gel, the main difference being that the gel strength decreases with a decrease in the methane concentration. From this, applicants conclude that the process of the present invention gels liquid cryogens which have a methane component irrespective of whether the methane component is very high, e.g. in excess of 70 mole percent, a majority of the cryogen, e.g. in excess of 50 mole percent, or only a minority, e.g. less than 50 mole percent of the liquid cryogen although the efficiency with which gelation takes places drops with a reduction in the proportion of methane in the liquid gel.

Lastly, Curve D, FIG. 3, illustrates the yield strength of a methane gel when steam is injected directly (without prior dilution) into the liquid methane in accordance with the above-described prior art gelling method. A comparison of Curve D with Curves A–C demonstrates the significant increase in the gel strength when the gelling agent is injected in accordance with the present invention.

From the foregoing it is apparent that the relative dilution of the steam in the methane (or LNG) vapor has a significant influence on the ultimate gel strength. The greater the dilution, the greater the gel strength. The limiting factor is primarily an economical one, namely the cost of recycling the additional vapor as the dilution ratio is increased. As a compromise, and taking into consideration that gelling agent concentrations below about 0.1% do not normally result in a satisfactory gel strength, the gelling agent concentration in the gel should be between about 0.1% to about 10% by weight when the gelling agent is water with the preferred range (for water) being between about 1.5% to about 5%. Further, although the dilution ratio between the cryogen vapor and the gelling agent vapor at the expansion station 26 may be readily achieved over the range from about 1:1 to about 20:1, a presently preferred range is between about 2:1 to about 4:1. This translates into a practical liquid cryogen flash vaporization requirement of between about 0.2% to about 20% (by weight) of the liquid cryogen.

Referring now primarily to FIGS. 1 and 2, under actual operating conditions the cryogen gel, e.g. the LNG gel, is typically stored at atmospheric pressure. Accordingly, it is desirable that the vapor-droplet flow in flow tube 14 and in cyclone separator 18 is also approximately at atmospheric pressure. Since the evaporation of the LNG to provide the required steam dilutant is best performed by flash vaporization, the incoming LNG flow in pipe 4 must have a temperature and must exceed atmospheric pressure so that the desired amount of LNG is vaporized. Accordingly, the liquid pressure drop at the expansion device, e.g. at venturi expander 12, is selected so that the desired amount of liquid LNG is vaporized and in order to assure such controlled evaporation the temperature of the incoming LNG is selected so that it is at or near to, e.g. in the vicinity of the boiling point for the LNG at the pressure prevailing in the inflow pipe 4. In other words, the incoming liquid cryogen is at about its saturation point.

For the above-summarized optimal process parameters, including storage of the gel at atmospheric pressure, an LNG pressure drop across the venturi expander 12 of between about 5 psi to about 25 psi will cover most process requirements with the preferred range being between about 10 psi to about 20 psi.

Table I illustrates the calculated influence of the methane inlet conditions on the amount of cryogen vaporization at the venturi expander, the steam requirements and conditions, the steam dilution downstream of the venturi expander, and the ultimate recovery of gel as well as the amount of cryogen vapor that must be recycled when preparing a gel having 2% by weight of water as the gelling agent. Similar calculations are readily performed for gases other than pure methane, e.g. for LNG or for gels having gelling agent concentrations other than 2% by weight of water. Table I illustrates the type of computations that are suggested and the process parameters and values one has to take into consideration when evaluating process economics and selecting optimum process conditions to prepare a given LNG gel, that is strength and LNG composition.

LNG at LNG conditioner 10 so that it is at or in the vicinity of the boiling point for the selected pressure. Consequently, booster pump 8 and conditioner 10 will normally only be necessary when the gelation system is an add-on feature to an existing liquefaction plant.

Referring now particularly to FIG. 2, LNG, or another cryogen having a methane component, is flowed in a downstream direction, that is to the right as seen in FIG. 2, into the venturi expander 12. As the flow passes the restricted throat 34 of the expander and enters its diverging, downstream portion 36 an amount of LNG will flash vaporize which is a function of both the pressure drop across the venturi and the temperature of the incoming LNG. The expansion of the LNG in the venturi (or in a corresponding device) not only causes the vaporization of a portion of the LNG but also atomizes the remaining LNG and forms a multitude of very small droplets, or a mist, that are suspended in the vapor and which, in combination, constitute a cryogen vapor-droplet flow downstream of the venturi.

In one embodiment of the invention, the steam injector 26, located downstream of the expanding portion 36 of the venturi, comprises a plurality, e.g. three or four equally spaced, radially oriented steam inlet ports 38 which are connected via a manifold (not shown) or the like to steam line 24. Steam is injected into the LNG

TABLE I

| INCOMING LIQUID METHANE (1) | | STEAM (2) | | | METHANE VAPOR-DROPLET FLOW (3), Quality | | CONDITIONS AT POINT OF GELANT INJECTION, Ratio of $CH_4$ Vapor to Steam | | Gelled $CH_4$ (5) | Recycle $CH_4$ lb $CH_4$ |
|---|---|---|---|---|---|---|---|---|---|---|
| Press. psia | Temp. °F. | Press. psia | Temp. °F. | Mass lb/lb $CH_4$ | % Wt. Vapor | % Vol. of vapor | lb/lb | Vol/vol (4) | lb gel/lb $CH_4$ | vapor/lb liquid $CH_4$ |
| 15 | −258.284 | 15 | 213.03 | .0181 | 0 | 0 | 0 | 0 | 0.9030 | .1151 |
| 20 | −251.750 | 20 | 227.96 | .0176 | 2.494 | 85.39 | 1.417 | 1.591 | 0.8801 | .1375 |
| 25 | −246.365 | 25 | 240.07 | .0172 | 4.569 | 91.62 | 2.653 | 2.979 | 0.8610 | .1562 |
| 30 | −241.744 | 30 | 250.33 | .0169 | 6.367 | 93.95 | 3.769 | 4.232 | 0.8446 | .1723 |
| 40 | −234.014 | 40 | 267.25 | .0163 | 9.407 | 95.96 | 5.758 | 6.466 | 0.8168 | .1995 |
| 50 | −227.617 | 50 | 281.01 | .0159 | 11.955 | 96.88 | 7.533 | 8.459 | 0.7935 | .2224 |
| 60 | −282.109 | 60 | 292.71 | .0155 | 14.180 | 97.42 | 9.170 | 10.30 | 0.7732 | .2423 |
| 70 | −217.841 | 70 | 302.92 | .0151 | 15.165 | 97.78 | 10.70 | 12.02 | 0.7552 | .2599 |
| 80 | −212.860 | 80 | 312.03 | .0148 | 17.976 | 98.04 | 12.17 | 13.67 | 0.7387 | .2761 |
| 90 | −208.861 | 90 | 320.27 | .0145 | 19.646 | 98.24 | 13.58 | 15.25 | 0.7235 | .2911 |
| 100 | −205.175 | 100 | 327.81 | .0142 | 21.202 | 98.40 | 14.94 | 16.78 | 0.7094 | .3048 |

(1) Saturated liquid $CH_4$
(2) Saturated vapor
(3) Vaporizing process assumed to be an adiabatic process to a final pressure of 15 psia
(4) Volume ratios when $CH_4$ and steam are at the same temperature and pressure
(5) Gelled with 2% $H_2O$ For a given gelling agent concentration the gel strength tapers off with a reduction of the methane component in the liquid cryogen and, therefore, in the cryogen gel as is discussed above and illustrated in FIG. 3.

From the foregoing it is now apparent that both the temperature and the pressure of the incoming liquid cryogen, e.g. LNG, immediately upstream of the veturi expander 12 must be controlled so that they are in the vicinity of the saturation condition for the cryogen, and they are, of course, influenced by the storage pressure for the LNG gel. If a natural gas liquefaction plant includes as one of its integral components a gelation system constructed in accordance with the present invention, the LNG should have the desired pressure and temperature indicated above. If, however, the gelation system is added to an existing plant, the condition of the LNG might vary from what is required at the venturi expander. Typically it may be necessary to (a) increase the pressure of the incoming LNG above atmospheric pressure to the above-indicated values and it may further be necessary to increase the temperature of the vapor-droplet flow that propagates towards cyclone separator 18 and becomes intimately mixed therewith. The injected steam immediately solidifies into a large number of small particles which are uniformly dispersed throughout the flow. Next, the flow enters the cyclone separator 18 where it is separated into a gaseous and a condensed or gel phase. The former comprises primarily cryogen, e.g. NG vapor which may include trace amounts of the gelling agent and/or LNG droplets. It is drawn off via vapor pipe 28. The latter, condensed phase comprises LNG and gelling particles and it is typically drained off the bottom of the cyclone and placed in storage tank 32 as above indicated.

It will be apparent that the process of the present invention can be performed with equipment other than that described above. Instead of a venturi expander other expansion devices can be used. Similarly, the separation of the vapor-droplet flow into two phases can be performed with devices other than cyclone separators and the injection of steam can be accomplished by means other than the illustrated, radially oriented steam inlet ports. These substitutions, however, do not affect the present invention and are well within the reach of those skilled in the art. They are, therefore, not further described herein.

We claim:

1. A process for transforming a liquid cryogen including methane into a cryogen gel comprising the steps of: converting the liquid cryogen into a body of cryogen comprising by weight a minority of cryogen vapor and a majority of cryogen droplets suspended in the vapor; adding to the cryogen body a gelling agent and in an amount so that the gelling agent forms at least about 0.1% by weight of the cryogen gel, the gelling agent being a solid at the temperature of the liquid cryogen and a liquid or a gas at ambient temperatures, the gelling agent being capable of forming a chemical complex with the methane; thereafter separating the body into a condensed phase comprising liquid cryogen and gelling agent and a gaseous phase comprising primarily cryogen vapor; and collecting the condensed phase in a container.

2. A process according to claim 1 including the step of providing a vessel for holding the body of cryogen, withdrawing the body of cryogen from the vessel at a given rate; and replenishing the withdrawn body of cryogen with fresh cryogen vapor, cryogen droplets and gelling agent at substantially the same rate at which they are withdrawn.

3. A process according to claim 2 wherein the steps of withdrawing and replenishing are continuous steps, and wherein the vessel comprises a tubular member so that the body flows through the tubular member at a substantially constant rate.

4. A process according to claim 1 including the step of recycling the gaseous phase, reliquefying the gaseous phase, and combining the reliquefied gaseous phase with the liquid cryogen prior to the step of converting.

5. A process according to claim 1 wherein the step of adding comprises the step of adding a gelling agent selected from the class consisting of water and methyl alcohol.

6. A process according to claim 1 wherein the step of adding comprises the step of adding a vaporized gelling agent to the body.

7. A process according to claim 1 wherein the step of adding comprises the step of adding the gelling agent so it is present in the gel in an amount of no more than about 25% by weight of the condensed cryogen.

8. A process for the continuous gelling of a liquid cryogen including methane comprising the steps of generating a stream of the cryogen at about the saturation point for the cryogen; reducing the pressure of the stream to flash vaporize a portion of the liquid cryogen to transform the stream into a flow of cryogen vapor and finely dispersed cryogen droplets suspended in the vapor; injecting a vaporized gelling agent into the flow, the agent being selected from the class consisting of water and methyl alcohol; and separating the flow into a condensed phase comprising cryogen liquid and gelling agent and a gaseous phase comprising cryogen vapor; whereby the gelling agent in the condensed phase causes the gelation of the latter.

9. A process according to claim 8 including the step of recycling the gaseous phase, reliquefying the gaseous phase, and combining the reliquefied gaseous phase with liquid cryogen upstream of a point where the gelling agent is injected into the flow.

10. A process according to claim 8 wherein the gelling agent comprises steam, and wherein the step of injecting comprises the step of injecting a quantity of steam so that water is present in the condensed phase in an amount not less than about 0.1% by weight of the condensed phase.

11. A process according to claim 10 wherein the step of injecting comprises the step of injecting a quantity of steam so that water is present in the condensed phase in the range from between about 0.1% to about 10% by weight of the condensed phase.

12. A process according to claim 11 including the step of storing the condensed phase at atmospheric pressure.

13. A process according to claim 12 including the step of conditioning the liquid cryogen so that it has a pressure in excess of atmospheric pressure prior to the step of reducing the pressure.

14. A process according to claim 13 wherein the step of reducing the pressure comprises the step of reducing the pressure to about atmospheric pressure.

15. A process according to claim 13 wherein the step of reducing the pressure comprises the step of reducing the pressure by an amount so that the flow comprises cryogen vapor in an amount from between about 0.2% to about 20% by weight of the cryogen liquid.

16. A process for the continuous gelling of a liquid cryogen including a majority of methane comprising the steps of generating a stream of the cryogen at a predetermined pressure; giving the cryogen stream a temperature which is in the vicinity of the boiling point for the liquid cryogen at the predetermined pressure; reducing the pressure of the liquid cryogen in the flowing stream at an expansion point for the stream so that a minor portion of the cryogen becomes vaporized while a remainder of the cryogen becomes atomized to thereby transform the cryogen stream into a flow of cryogen vapor and cryogen droplets; injecting into the flow a vaporized gelling agent at a rate selected so that the volume of the vaporized gelling agent at least about equals the volume of the cryogen vapor, the gelling agent being a solid at the temperature of the liquid cryogen and a liquid or a gas at ambient temperatures, the gelling agent being capable of forming a chemical complex with the methane, and segregating from the flow the cryogen droplets and the chemical complex; whereby the chemical complex causes the gelling of the segregated cryogen droplets to thereby form a cryogen gel.

17. A process according to claim 16 wherein the step of injecting the gelling agent comprises the step of injecting a sufficient amount of gelling agent so that it is present in the cryogen gel in the range of between about 0.1% to about 25% by weight of the gel.

18. A process according to claim 17 wherein the step of reducing the pressure of the cryogen liquid stream comprises the steps of flowing the liquid cryogen through an expansion device, and reducing the pressure by an amount so that prior to the step of injecting the gelling agent the amount of cryogen vapor is no greater than about 20% by weight of the stream.

19. A process according to claim 16 wherein the cryogen liquid comprises natural gas and the gelling agent comprises stream; and wherein the steps of reducing the pressure and injecting the gelling agent are selected so that the volume ratio of cryogen vapor in the flow to steam is no more than about 20:1.

20. A process according to claim 19 wherein said ratio is at least about 1:1.

21. A process according to claim 19 wherein said ratio is in the range of about 2:1 to 4:1.

22. A process according to claim 19 wherein the step of injecting the steam comprises the step of injecting a quantity of steam so that water is present in the cryogen gel in an amount of between about 0.1% to about 10% by weight of the cryogen gel.

23. A process according to claim 22 wherein water is present in the cryogen gel in an amount of between about 1.5% to about 5% by weight of the cryogen gel.

24. A process according to claim 16 wherein the step of reducing the pressure comprises the step of reducing the pressure by at least about 5 psi.

25. A method according to claim 24 wherein the step of reducing the pressure comprises the step of reducing the pressure by between about 10 to about 20 psi.

26. A process according to claim 24 wherein the step of injecting comprises the step of injecting a gelling agent having at least a methyl alcohol component at a rate so that the gelling agent comprises no more than about 25% weight percent of the cryogen gel.

27. A process for the continuous transformation of a liquid cryogen including at least about 70 mole percent of liquid methane into a cryogen gel for storage or shipment of the cryogen gel at a predetermined storage pressure, the method comprising the steps of: pressurizing the liquid cryogen so that it exceeds the predetermined storage pressure by at least about 5 psi; giving the pressurized, liquid cryogen a temperature so that upon the reduction of the pressure of the liquid cryogen to about the storage pressure no more than about 20% by weight of the liquid cryogen substantially instantaneously vaporizes; flowing the liquid cryogen to an expansion station; reducing the pressure on the liquid cryogen flowing past the expansion station to about the storage pressure; whereby a portion of the liquid cryogen vaporizes and a remainder is atomized into liquid cryogen droplets to form a cryogen vapor-droplet flow; injecting into the flow a vaporized gelling agent selected from the class consisting of water and methyl alcohol in an amount so that the gelling agent constitutes at least about 0.1% by weight of the cryogen gel; whereby the injected gelling agent solidifies and forms finely dispersed gelling particles; segregating the flow into a condensed phase comprising liquid cryogen and particles and into a gaseous phase comprising primarily cryogen vapor; and collecting the condensed phase in a container; whereby the particles in the liquid phase cause the gelling of the liquid cryogen in the condensed phase to form said cryogen gel.

28. A process according to claim 27 including the step of reliquefying the gaseous phase, and combining the reliquefied gaseous phase with the liquid cryogen prior to the step of reducing the pressure.

29. A process according to claim 27 wherein the step of injecting comprises the step of injecting an amount of gelling agent so that it constitutes no more than about 25% of weight of the cryogen gel.

30. A process according to claim 29 wherein the gelling agent comprises water and constitutes no more than about 10% by weight of the cryogen gel.

31. A process according to claim 29 wherein the gelling agent comprises methyl alcohol.

32. A process according to claim 29 wherein the gelling agent comprises a mixture of water and methyl alcohol.

33. A gelled cryogen liquid composition comprising methane and a gelling agent which is a solid at the temperature of the liquid cryogen and a liquid or a gas at ambient temperatures, the gelling agent being capable of forming a chemical complex with the methane, the chemical complex being finely and uniformly dispersed throughout the composition, the gelling agent being present in the composition in the range of between about 0.1% to about 25% by weight of the composition, the gelling agent having been contacted with the methane while a portion of the methane was in gaseous form and a remainder of the methane comprised a mist of fine methane droplets suspended in said portion.

34. A cryogenic gel comprising a composition having a majority of methane, a gelling agent uniformly distributed through the composition, being present in an amount no more than about 25% by weight of the composition, and being selected from the class consisting of water and methyl alcohol, the gelling agent having been added to the composition while a minor portion thereof by weight was in a gaseous state and a remainder thereof comprised a mist of fine composition droplets suspended in said portion.

35. A composition according to claim 34 wherein the composition comprises at least about 70 mole percent of methane.

36. A composition according to claim 35 wherein the gelling agent comprises water and forms between about one to about 5% by weight of the composition.

37. A gelled cryogen liquid produced by:

(a) adjusting the temperature of a flowing stream of liquefied natural gas to a temperature approximately equal to the saturation temperature;

(b) flashing the stream of natural gas to a lower pressure, whereby a mixture of gas and liquid droplets is formed;

(c) injecting a vaporized gelling agent into the flowing mixture of gas and liquid in an amount not exceeding 25% by weight of the amount of the liquid and gas mixture flowing thereby, said gelling agent being selected from the class consisting of water and methyl alcohol, whereby the liquid droplets of natural gas are solidified; and (d) separating the solidified droplets from the vapor to form a product stream of gelled cryogen liquid.

* * * * *